United States Patent [19]

Uchida et al.

[11] 4,068,486

[45] Jan. 17, 1978

[54] AUTOMATIC TUNNEL FACE HYDRAULIC PRESSURE CONTROLLING APPARATUS IN SHIELD TYPE HYDRAULIC TUNNEL BORING SYSTEM

[75] Inventors: Yoshiaki Uchida, Koshigaya; Akira Nakaya; Kunitaka Saito, both of Tokyo, all of Japan

[73] Assignee: Tekken Construction Co., Ltd., Tokyo, Japan

[21] Appl. No.: 767,038

[22] Filed: Feb. 9, 1977

[30] Foreign Application Priority Data

Sept. 8, 1976 Japan ..... 51-106820

[51] Int. Cl.[2] ..... E21D 9/00

[52] U.S. Cl. ..... 61/85; 415/1

[58] Field of Search ..... 61/42, 84, 85; 415/1; 299/10

[56] References Cited

U.S. PATENT DOCUMENTS

| | | | |
|---|---|---|---|
| 3,334,945 | 8/1967 | Bartlett | 61/85 X |
| 3,769,804 | 11/1973 | Matsushima | 61/85 |
| 3,778,107 | 12/1973 | Haspert | 61/85 X |

FOREIGN PATENT DOCUMENTS

| | | | |
|---|---|---|---|
| 250,968 | 2/1970 | U.S.S.R. | 61/85 |

*Primary Examiner*—Paul R. Gilliam
*Assistant Examiner*—David H. Corbin
*Attorney, Agent, or Firm*—Burns, Doane, Swecker & Mathis

[57] ABSTRACT

An apparatus for automatically controlling tunnel face hydraulic pressure in a hydraulic chamber defined by a rotary cutter head and bulkhead in a shield type excavator used in hydraulic tunnel boring system including a pipe for feeding a hydraulic material with a feeding pump from a reservoir to the chamber and a pipe for discharging a mixture of the fed hydraulic material with ground formations excavated by the cutter head from the chamber to the reservoir with a discharging pump. The apparatus substantially comprises a first pressure gauge for measuring actual tunnel face hydraulic pressure in the chamber, a feeding-pipe bypass provided close to the chamber, a first pressure regulating valve provided in the bypass, a second pressure regulating valve in the feeding pipe bypassed by the bypass, a first pressure regulator in which a first predetermined feeding pressure is preset for comparing the actual pressure measured by the first gauge with the first predetermined feeding pressure and controlling the second valve responsive to any differences between the both pressures compared in the first regulator, a second pressure gauge for measuring fed-hydraulic-material pressure upstream the bypass a third pressure regulating valve provided in the feeding pipe upstream the second pressure gauge, and a second pressure regulator in which a second predetermined feeding pressure is preset for comparing the measured fed-hydraulic-material pressure with the second predetermined pressure and controlling the third valve responsive to any differences between the both pressures compared in the second regulator. The second predetermined feeding pressure is preferrably made slightly higher than the first predetermined feeding pressure.

4 Claims, 3 Drawing Figures

Figure 1:
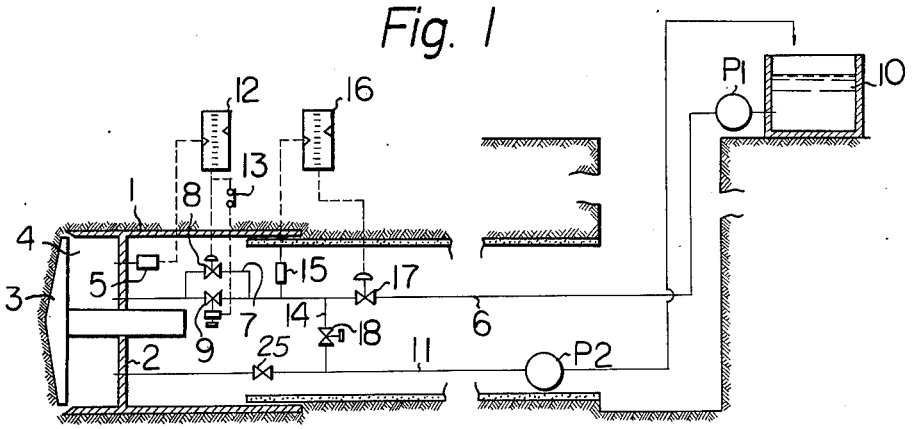

AUTOMATIC TUNNEL FACE HYDRAULIC PRESSURE CONTROLLING APPARATUS IN SHIELD TYPE HYDRAULIC TUNNEL BORING SYSTEM

This invention relates to shield type hydraulic tunnel boring systems and, more particularly, to improvements in apparatuses for automatically controlling hydraulic pressure on tunnel face of ground layer being bored by tunnel boring shield excavator.

Generally, it is very important for performing the hydraulic tunnel boring to properly maintain the hydraulic pressure on the tunnel face since, in the case when the hydraulic pressure becomes unstable, the ground layer which is generally unstable where the hydraulic boring system is employed may easily collapse even entailing serious ground sinking due to so-called piping phenomenon or the like with possible expansion and contraction of the layer around the tunnel face. It is absolutely necessary, therefore, to maintain the tunnel face hydraulic pressure stably constant during the tunnel boring.

In order to maintain the tunnel face hydraulic pressure constant in the boring system of the kind referred to, there has been suggested in, for example, the U.S. Pat. No. 3,769,804 a method wherein a hydraulic pressure setter included in a pressure regulator is set at a predetermined pressure, a pressure indicating signal transmitter is provided in a hydraulic chamber formed at boring head behind a rotary cutter of the tunnel boring shield excavator, any fluctuations in the hydraulic pressure inside the chamber are detected by the transmitter and an electric signal representing an external disturbance to the predetermined pressure is presented to the regulator, whereby a pump associated with a pipe for feeding a hydraulic material to the hydraulic chamber is precisely adjusted in its pumping rate and thus the hydraulic material fed is properly adjusted in its amount required for maintaining the predetermined pressure. According to this method, on the other hand, the feeding pump is installed on the ground surface so as to be at a distance from the tunnel face, which distance being increased as the boring advances, and results of adjustments of the hydraulic material feeding rate or amount at the end of the tunnel face is subject to a certain time lag due to such distance. There has been also suggested as another measure to control the feeding amount of the hydraulic material by means of a valve provided in the feeding pipe, but it is difficult to expect a quick rise of the hydraulic pressure at the tunnel face due to restricted amount of the material fed by the pump so that the tunnel face hydraulic pressure cannot be controlled promptly when the same is decreased.

The present invention has been suggested to remove such defects as described above, successfully regulating the tunnel face hydraulic pressure involving less time lag with a provision of a regulating valve in the hydraulic material feeding pipe at a position close to the hydraulic chamber of the excavator and controlling the regulating valve and the hydraulic material feeding pump.

A primary object of the present invention is, therefore, to provide an automatic controlling apparatus for the tunnel face hydraulic pressure in the shield type hydraulic tunnel boring system, which is capable of achieving the control quickly.

Another object of the present invention is to provide an automatic controlling apparatus of the kind referred to which is capable of finely regulating the tunnel face hydraulic pressure.

A further object of the present invention is to provide an automatic controlling apparatus of the kind referred to which is capable of controlling the tunnel face hydraulic pressure over a large range.

Yet another object of the present invention is to provide an automatic controlling apparatus of the kind referred to which achieves a smooth control of the tunnel face hydraulic pressure.

Figure 2:
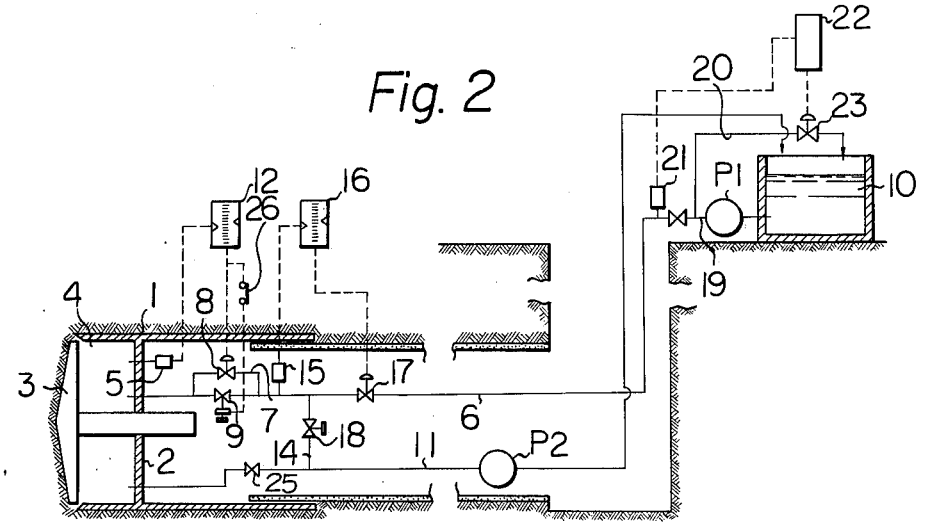
Figure 3:
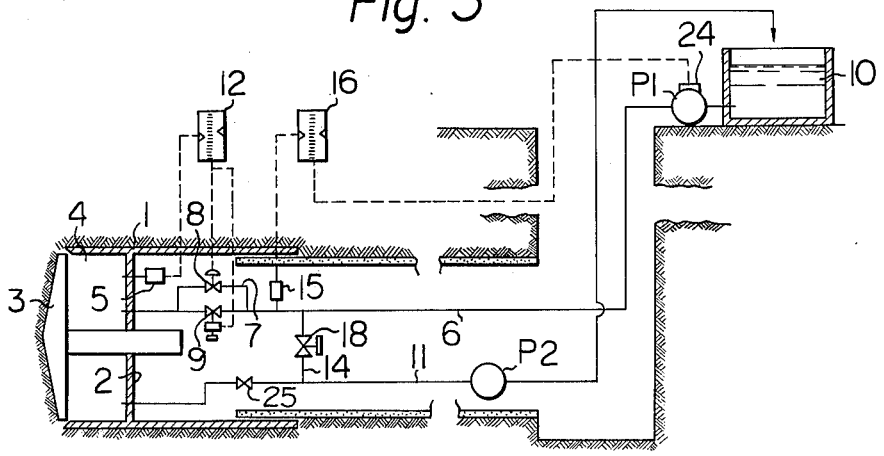

Other objects and advantages of the present invention will be made clear as the following explanations of the invention advance as detailed with reference to preferred embodiments of the invention shown in accompanying drawings, in which:

FIG. 1 is a schematic sectioned view showing an entire shield type hydraulic tunnel boring system employing an embodiment of the automatic hydraulic pressure controlling apparatus according to the present invention; and FIGS. 2 and 3 are respectively a view similar to FIG. 1 showing the system employing other embodiment of the present invention.

Referring to FIG. 1, a pressure gauge 5 for measuring an actual tunnel face hydraulic pressure in a hydraulic chamber 4 formed between a bulkhead 2 of a shield excavator 1 and a cutter head 3 rotated by a motor or the like (not shown) is provided at the bulkhead 2, and a second pressure regulating valve 9 is provided at a position close to the bulkhead 2 in a pipe 6 for feeding such hydraulic material as slurry, muddy water or even plain water (which shall be referred to as "water" hereinafter for simplicity) to the chamber 4 from a tank 10 installed on the ground surface through a pump P1 and a third regulating valve 17. Further, a pipe 11 for discharging a mixture of excavated ground formations with the water is connected at one end to the chamber 4 through the bulkhead 2 and at the other end to the upper open end of tank 10 through a fourth regulating valve 24 and pump P2. A first bypass pipe 7 is provided in the feeding pipe 6 across the second regulating valve 9 and there is provided a first regulating valve 8 in this bypass pipe 7, downstream the third valve 17. Further, a second bypass pipe 14 is provided between the feeding pipe 6 and the discharging pipe 11. This second bypass pipe 14 is positioned at one end thereof between the second and third regulating valves 9 and 17 in the feeding pipe 6 and at the other end between the fourth regulating valve 24 and the pump P2 in the discharging pipe 11. An electric signal indicating the actual hydraulic pressure measured by the pressure gauge 5 is given to a first tunnel face hydraulic pressure regulator 12 which is connected to the gauge 5 to compare the signal with a predetermined feeding water pressure value preliminarily set in the regulator 12 and to present an electric signal denoting any difference between the actual pressure and the predetermined pressure to the first regulating valve 8 to controllably operate the same. This signal from the regulator 12 is also given to the second regulating valve 9 through a switch 13 to control the valve 9. A second pressure gauge 15 is provided in the feeding pipe 6 at a position upstream the first bypass pipe 7, that is, between the second regulating valve 9 and the third regulating valve 17. A signal representing a fed water pressure at the position is produced by the gauge 15 and is given to a second tunnel face hydraulic pressure regulator 16. In similar manner to the first regulator 12, the second regulator 16 generates a signal indicating any difference between a predetermined feeding water pressure preset in the regulator 16 and an actual feeding water pressure measured by the gauge 15 at said position, which signal is given to the third regulating valve 17 to controllably operate the same.

The operation of this embodiment is as follows. In the first and second tunnel face hydraulic pressure regulators 12 and 16, the predetermined pressure set in the second regulator 16 is set to be a little higher than the predetermined pressure set in the first regulator 12, so that any slight decreasing variations in the tunnel face hydraulic pressure with respect to the required pressure for the boring can be regulated only by means of the regulating valve 17.

It should be here noted that, in the present invention, all the regulating valves 8, 9 and 17 are provided in the water feeding pipe 6 at respective positions close to the hydraulic chamber 4 so that any variations in the tunnel face hydraulic pressure caused due to variations in working states of the boring excavator 1 between its operating state and non-operating state can be responded to immediately. That is, the signal from the pressure gauge 5 regulates the regulating valves 8 and 9 near the bulkhead 2 through the regulator 12 to regulate flow volume of the water being fed through the feeding pipe 6, causing substantially no time lag to be produced. Further, as the second pressure gauge 15 controllably operates the regulating valve 17 through the regulator 16, the water pressure sent to the regulating valves 8 and 9 will be kept substantially constant. The diameter of the first bypass pipe 7 is much smaller than the diameter of the feeding pipe 6 so that the first regulating valve 8 will act more sensitively than the second regulating valve 9 to reduce the variation of the tunnel face hydraulic pressure remarkably smoothly. Further, the pressure gauge 15, regulator 16 and regulating valve 17 serve to keep the water pressure passing through the regulating valves 8 and 9 substantially constant.

FIG. 2 shows another embodiment of the present invention, wherein a means for controlling the amount of water fed to the feeding pipe 6 from the pump P1 is additionally provided. For this purpose, a third bypass pipe 20 is provided as connected at an end to outlet port 19 of the pump P1 and opened at the other end above the tank 10. The water feeding pipe 6 connected to the outlet port 19 is provided with a third pressure gauge 21 which measures actually incoming water pressure and transmits a signal corresponding to the pressure at a position near the outlet port 19. This incoming pressure signal is presented to a third regulator 22 which also generates a signal denoting any difference between the actually incoming pressure value and a predetermined pressure value preset in the regulator 22 and gives such signal to a fifth regulating valve 23 provided adjacent the opened end of the third bypass 20, so that an excessive water over the predetermined pressure value of the fed water if any will be discharged through the bypass pipe 20 and valve 23 controllably opened by the difference signal from the regulator 22 and thereby the incoming water pressure into the pipe 6 is kept at the predetermined pressure at the initial stage. In this case, the pump P1 does not need to be of a variable speed type.

FIG. 3 shows a further preferred embodiment of the present invention, in which the regulating valve 17 in the first embodiment of FIG. 1 is omitted but, instead, the electric signal generated by the second regulator 16, that is, the signal of the difference between the predetermined pressure and the actual pressure measured by the gauge 15, is given to a variable speed mechanism 21 for controlling pumping rate of the pump P1 to increase or decrease the amount of the water fed by the pump P1 and thus to control the water pressure in the feeding pipe 6.

According to the present invention, as has been described above, the pressure gauge in the hydraulic pressure chamber controls the first and second water-pressure regulating valves, and the further pressure gauge in the feeding pipe on the inlet side of these regulating valves controls the amount of fed water in the water feeding pipe, whereby it is made possible to reduce the range of variations in the tunnel face hydraulic pressure and to smoothly vary or control the water pressure.

What is claimed is:

1. In a hydraulic tunnel boring system using a shield type boring excavator including a hydraulic pressure chamber defined between a rotary cutter head and a bulkhead, said chamber is filled with a hydraulic material fed through a feeding pipe from a hydraulic material reservoir and a mixture of said material and ground formations excavated by rotation of said cutter head is discharged through a discharging pipe to the reservoir, an apparatus for automatically controlling tunnel face hydraulic pressure in the chamber, which comprises a first pressure gauge provided in the chamber for measuring the tunnel face hydraulic pressure, a first bypass pipe of said feeding pipe provided at a position close to said bulkhead, a first pressure regulating valve provided in said first bypass pipe, a second pressure regulating valve provided in the feeding pipe so that the first bypass pipe will be disposed across said second regulating valve, a first pressure regulator connected to said first pressure gauge and second regulating valve for controlling the second valve in response to differences if any between the tunnel face hydraulic pressure measured by the first pressure gauge and a predetermined feeding pressure preliminarily set in said first pressure regulator, a second pressure gauge provided in the feeding pipe upstream the first bypass pipe for measuring fed-hydraulic-material pressure in the feeding pipe, a third pressure regulating valve provided in the feeding pipe upstream said second pressure gauge, and a second pressure regulator connected to said second pressure gauge and third regulating valve for controlling the third regulating valve in response to differences if any between said fed-hydraulic-material pressure measured by the second pressure gauge and a predetermined feed pressure preliminarily set in said second pressure regulator.

2. An apparatus according to claim 1 wherein said first bypass pipe has a smaller diameter than the feeding pipe.

3. An apparatus according to claim 1 which further comprises a second bypass pipe including a fourth pressure regulating valve and provided between said feeding pipe and said discharging pipe at a position downstream said third regulating valve.

4. An apparatus according to claim 1 which further comprises a hydraulic material feeding pump provided in the feeding pipe substantially adjacent said reservoir, a third bypass pipe connected at an end to the feeding pipe on outlet side of said feeding pump and opened at the other end above the reservoir, a third pressure gauge provided in the feeding pipe at a position downstream said third bypass for measuring initial fed-hydraulic-material pressure, a fifth pressure regulating valve provided in the third bypass pipe, and a third pressure regulator connected to said third pressure gauge and fifth regulating valve for controlling the fifth valve in response to differences if any between said initial fed-hydraulic-material pressure measured by the third pressure gauge and a predetermined initial feeding pressure preliminarily set in said third pressure regulator.

* * * * *